US006692685B1

(12) United States Patent
Willingham

(10) Patent No.: US 6,692,685 B1
(45) Date of Patent: Feb. 17, 2004

(54) SEALING CLOSURE FOR EXTRUSION BLOW MOLDED CONTAINERS

(75) Inventor: Wendell D. Willingham, Perrysburg, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 10/330,921

(22) Filed: Dec. 27, 2002

Related U.S. Application Data

(62) Division of application No. 09/739,949, filed on Dec. 18, 2000, now Pat. No. 6,533,136.

(51) Int. Cl.[7] ..... B29C 49/04; B29C 49/72

(52) U.S. Cl. ..... 264/524; 264/536; 264/540

(58) Field of Search ..... 264/524, 536, 264/540

(56) References Cited

U.S. PATENT DOCUMENTS

| | | | | |
|---|---|---|---|---|
| 2,916,174 | A | 12/1959 | Orr | 215/277 |
| 3,079,023 | A | 2/1963 | Mendiola | |
| 3,300,072 | A | 1/1967 | Caviglia | |
| 3,767,076 | A | 10/1973 | Kennedy | |
| 3,784,038 | A | 1/1974 | Uhlig | |
| 3,788,510 | A | 1/1974 | Collins | |
| 3,817,418 | A | 6/1974 | Mastrovito | |
| 3,901,404 | A | 8/1975 | Feldman | 215/256 |
| 3,973,690 | A | 8/1976 | Schneider | |
| 4,114,775 | A | 9/1978 | Shinozaki | |
| 4,210,251 | A | 7/1980 | Grussen | |
| 4,351,443 | A | 9/1982 | Uhlig | |
| 4,386,712 | A | 6/1983 | DeWallace | |
| 4,498,597 | A | 2/1985 | Bashour | |
| 4,523,904 | A | 6/1985 | Martin | |
| 4,531,649 | A | 7/1985 | Shull | |
| 4,574,966 | A | 3/1986 | Sandhaus | |
| 4,658,977 | A | 4/1987 | Crisci | |
| 4,667,839 | A | 5/1987 | Crisci | |
| 4,687,114 | A | 8/1987 | Crisci | |
| 4,722,447 | A | 2/1988 | Crisci | |
| 4,722,448 | A | 2/1988 | Nolan | |
| 5,100,009 | A | 3/1992 | Thompson et al. | |
| 5,383,558 | A | 1/1995 | Wilkinson et al. | |
| 5,421,470 | A | 6/1995 | Dudzik | |
| 5,489,036 | A | 2/1996 | Arkins | 215/343 |
| 5,630,522 | A | 5/1997 | Montgomery | |
| 5,829,608 | A | 11/1998 | Clerget | |
| 5,851,479 | A | 12/1998 | McGlynn et al. | |
| 5,984,124 | A | 11/1999 | Takano | |
| 6,105,801 | A | 8/2000 | Minnette | |
| 6,142,325 | A | 11/2000 | Chomik | |

FOREIGN PATENT DOCUMENTS

| | | |
|---|---|---|
| EP | 0864505 | 9/1998 |

*Primary Examiner*—Suzanne E. McDowell

(57) ABSTRACT

A method of making a package that includes the steps of blow molding a hollow plastic container, including blow molding a finish and a moil or dome that extends from the finish, and trimming the moil from the container finish so as to leave a conical flange extending inwardly and upwardly from the finish terminating in a smooth trimmed surface. A closure is provided having a base wall and a peripheral skirt. A liner is secured to the base wall within the skirt, and has a sealing surface spaced from the skirt. The closure is secured to the container finish in such a way that the container flange extending from the finish is deformed radially inwardly and axially downwardly by a peripheral portion of the liner so as to bring the trimmed surface of the container flange into abutment sealing engagement with the sealing surface of the liner. In various embodiments of the invention, the radially outwardly facing sealing surface on the liner is conical, convex, or formed by a hooked protrusion that extends axially from the liner.

1 Claim, 2 Drawing Sheets

SEALING CLOSURE FOR EXTRUSION BLOW MOLDED CONTAINERS

This application is a division of application Ser. No. 09/739,949 filed Dec. 18, 2000, now U.S. Pat. No. 6,533,136.

The present invention is directed to container and closure packages in which the container is extrusion blow molded, and more particularly to a closure for sealing engagement with a trimmed surface at the finish of an extrusion blow molded plastic container.

BACKGROUND AND SUMMARY OF THE INVENTION

Extrusion blow molded (EBM) plastic containers are conventionally formed by extruding a tube of plastic material, capturing the tube between opposing mold halves, and forming the tube against the internal surfaces of the mold halves by injection or blowing with air under pressure. See, for example, U.S. Pat. Nos. 4,523,904 and 5,851,479. Employing conventional technology, there can be a mismatch between adjacent edges of the mold halves on the order of as much as 0.010 to 0.015 inch, leading to formation of a step-like structure on the outer surface of the container along the line(s) of mold mismatch. When a closure is applied to the blow-molded finish of such a container, sealing engagement between the closure and the container surface can be less than optimum at the area of mold mismatch, reducing shelf life of the product within the container.

It is a general object of the present invention to provide a container and closure package, and a method of making such a package, in which the closure is constructed for sealing engagement with a trimmed area of the container finish, as distinguished from an external surface area of the container finish, so that mold mismatch during the container forming operation will not reduce the effectiveness of such sealing engagement, and shelf life of the package will be improved. Another object of the present invention is to provide a closure constructed for sealing engagement with a trimmed area of an extrusion blow molded container finish.

A method of making a package in accordance with one aspect of the present invention includes the steps of blow molding a hollow plastic container, including blow molding a finish and a moil or dome that extends from the finish, and trimming the moil or dome from the container finish so as to leave a conical flange extending inwardly and upwardly from the finish terminating in a smooth trimmed surface. A closure is provided having a base wall and a peripheral skirt. A liner is secured to the base wall within the skirt, and has a radially outwardly facing sealing surface spaced from and opposed to the skirt. The closure is secured to the container finish in such a way that the conical flange of the container extending from the finish is deformed radially inwardly and axially downwardly by a peripheral portion of the liner so as to bring the trimmed surface of the container flange into abutment sealing engagement with the sealing surface of the liner. In various embodiments of the invention, the radially outwardly facing sealing surface on the liner is conical, convex, or formed by a hooked protrusion that extends axially from the liner. Sealing engagement between the closure and the container is thus obtained at least in part between the closure liner and a trimmed surface of the container finish.

A container and closure package in accordance with another aspect of the present invention includes a closure having a base wall and a peripheral skirt with internal means, such as an internal thread or bead, for securing the closure to a container. A liner is secured to the base wall of the closure within the skirt. The liner has a radially outwardly oriented sealing surface spaced from and opposed to the skirt, and a liner periphery extending from the sealing surface toward the skirt. A container has a finish with external means, such as an external thread or bead, for securement of the closure, and an axially outwardly and radially inwardly extending flange flexibly coupled to the finish and terminating in a smooth sealing surface. The flange is deformed inwardly and downwardly by the liner periphery as the closure is secured to the container finish so as to drive the sealing surface on the flange into opposed sealing engagement with the sealing surface on the liner.

A closure in accordance with another aspect of the present invention includes a plastic shell having a base wall and a peripheral skirt with internal means, such as an internal thread or bead, for securing the closure to the finish of a container. A flexible resilient plastic liner is secured to the base wall of the closure within the skirt, such as by being compression molded in situ against the base wall, or less preferably by being formed separately and secured to the base wall of the closure. The liner has a radially outwardly oriented sealing surface spaced from and opposed to the closure skirt for opposed abutment sealing engagement with a trimmed surface on the container finish. The liner has a peripheral portion between the sealing surface and the closure skirt for slidable camming engagement with a container finish to deform the container finish axially and radially into abutment sealing engagement with the sealing surface on the liner.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
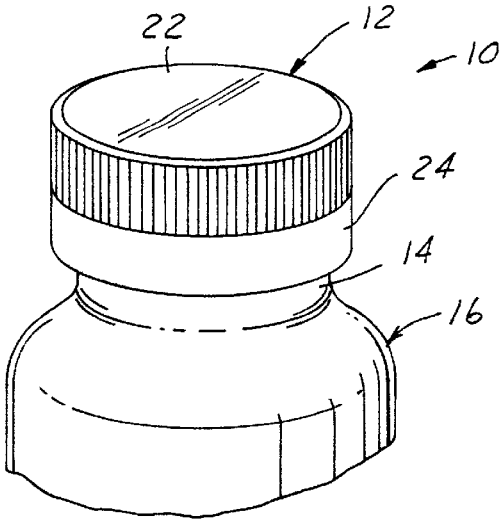
FIG. 1 is a fragmentary perspective view of a container and closure package in accordance with a presently preferred embodiment of the invention.
Figure 2:
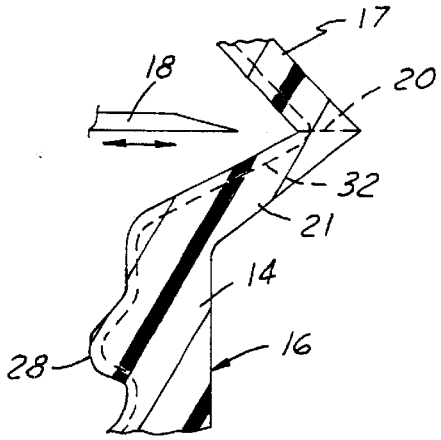
FIG. 2 is a fragmentary sectional view that illustrates trimming of the container finish in accordance with the present invention.

FIG. 1 illustrates a container and closure package 10 as comprising a closure 12 secured to the finish 14 of a container 16. Closure 12 may be of suitable plastic composition, such as polypropylene, formed in a conventional injection or compression molding operation. Container 16 is also of suitable plastic composition, such as polyethylene, and formed in a so-called extrusion blow molding (EBM) operation. An extruded tube or parison is captured between a pair of mold halves and blown to the internal confines of the mold halves. Apparatus and processes for extrusion blow molding plastic containers are disclosed, for example, in U.S. Pat. Nos. 4,523,904 and 5,851,479, the disclosures of which are incorporated by reference for purposes of background. Following the molding operation, the container has a dome or moil 17 (FIG. 2) integrally extending from container finish 14. This moil 17 is trimmed by a cutting blade or guillotine 18 to form a trimmed surface 20. The trimmed moil 17 is typically reground and recycled in the forming process. The trimming operation in accordance with the invention is along a plane perpendicular to the axis of finish 16, thus leaving a conical flange 21 extending upwardly and inwardly from container finish 16. Surface 20 is at an angle to container flange 21.

Figure 3:
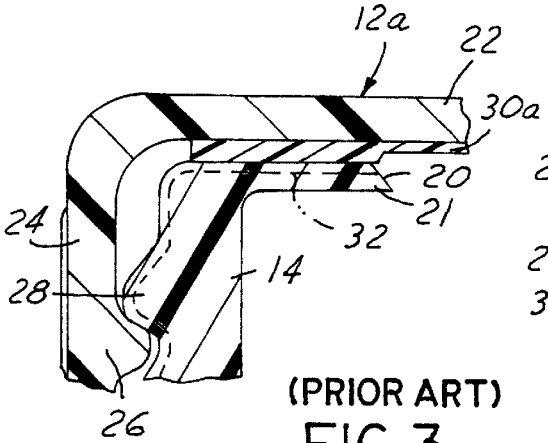
(PRIOR ART) FIG. 3
FIG. 3 is a fragmentary sectional view of the package illustrated in FIG. 1 with a closure/container sealing arrangement in accordance with the prior art.

FIG. 3 illustrates a closure 12*a* as comprising a hollow plastic shell with a base wall 22 and an integral peripheral skirt 24 extending axially from base wall 22. Skirt 24 has one or more internal threads or beads 26 for securing closure 12*a* to one or more external threads or beads 28 on the finish 14 of container 16. A liner 30 is internally secured to base wall 22 for sealing engagement with container finish 14. Liner 30 may be of any suitable resilient resin composition, as disclosed for example in U.S. Pat. Nos. 4,984,703, 5,306,542 or 5,925,430, or EP 0 926 078 A1 or 0 926 215 A1. The liner is preferably compression molded in situ within closure 12*a* against base wall 22, as disclosed for example in U.S. Pat. No. 5,451,360. Alternatively, liner 30 may be separately formed, and laid into and secured to base wall 22 of closure 12*a*. During the container molding operation, there can be significant mismatch between the mold halves, potentially leading to formation of a significant step or ledge 32 (FIGS. 2 and 3) along the external surface of container finish 14. When closure 12*a* (FIG. 3) is designed to make sealing engagement with the external as-molded surface of container finish 14, such as with the external untrimmed surface of container finish flange 21, the ledge 32 caused by mold mismatch in the container forming operation can lead to leakage through the sealing area, thereby significantly reducing shelf life of the closure and container package.

Figure 4:
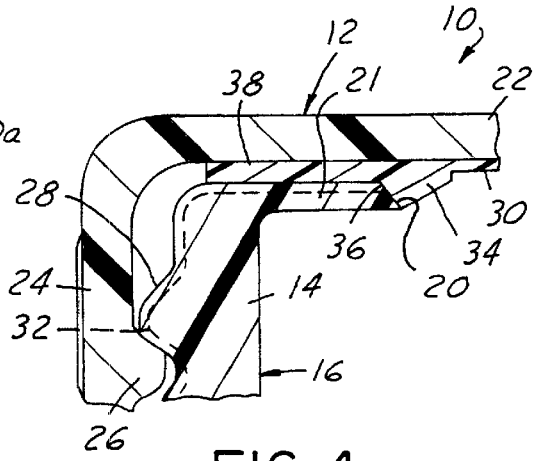
FIG. 4 is a fragmentary sectional view similar to that of FIG. 3 but showing a closure/container sealing arrangement in accordance with one presently preferred embodiment of the invention.
Figure 5:
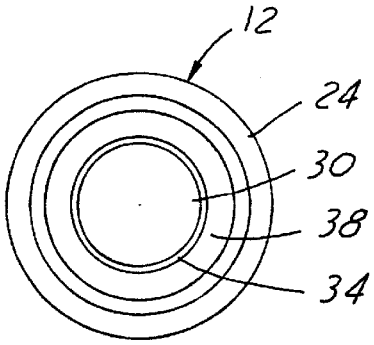
FIG. 5 is a bottom plan view of the closure illustrated in FIG. 4.

FIGS. 4 and 5 illustrate a package 10 containing a closure 12 in accordance with the present invention. Liner 30 is molded to possess an annular axial rib or protrusion 34 that has a surface 36 facing closure skirt 24. As closure 12 is applied to container finish 14, trimmed surface 20 of finish conical portion 21 initially engages the opposing peripheral portion 38 of liner 30. Continued application of closure 12 causes sliding of trimmed surface 20 along liner portion 38, bending or pivoting finish portion 21 radially inwardly and axially downwardly, ultimately forcing trimmed surface 20 into opposed abutment sealing engagement with conical surface 36 of liner protrusion 34. The angle of liner face or surface 36 complements that of surface 20 when finish flange 21 is horizontal, so that surfaces 20, 36 are in opposed abutment throughout their annular lengths. Inasmuch as surface 20 is formed during the trimming operation illustrated in FIG. 2, and is smooth and flat containing no step or shoulder 32 formed by mold mismatch, there is no such step or ledge in sealing engagement with liner portion 34, thereby obtaining improved sealing engagement between the container finish and the liner.

Figure 6:
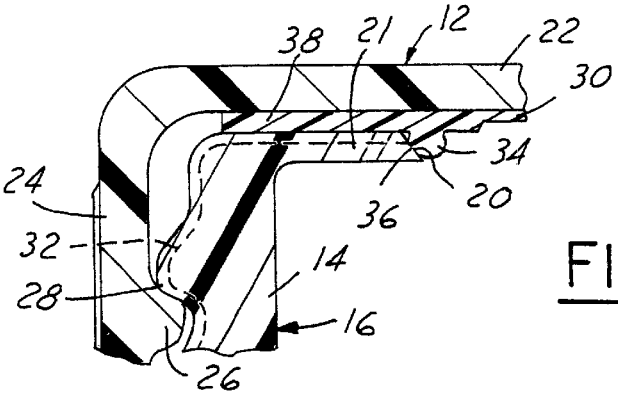
FIG. 6 is a fragmentary sectional view similar to that of FIG. 4 but showing a second embodiment of the invention.
Figure 7A:
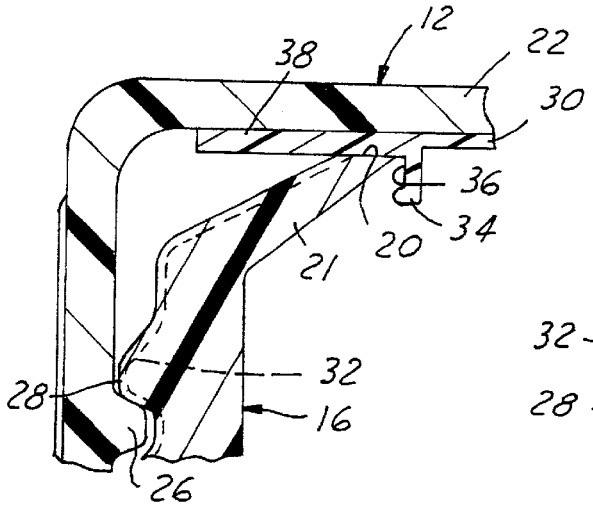
FIGS. 7A and 7B are fragmentary sectional views similar to those of FIGS. 4 and 6 but showing a third embodiment of the invention.
Figure 7B:
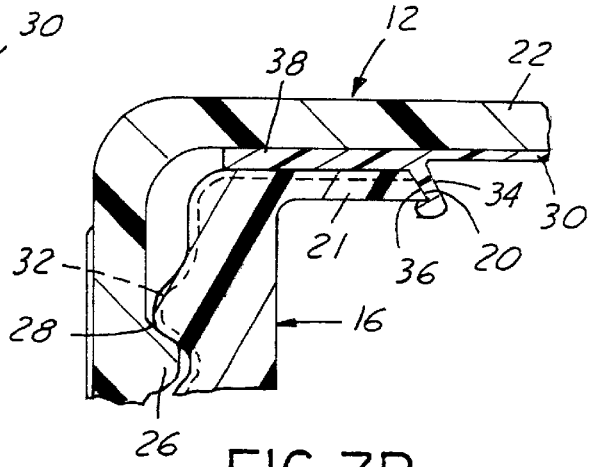

FIG. 6 illustrates a closure 12 in which the annular liner protrusion 34 forms a convex surface 36 for O-ring like sealing engagement with the opposing trimmed surface 20 of container finish flange 21. Again, sealing engagement between liner surface 36 and the opposing smooth trimmed surface 20 of container finish portion 21 obtains improved sealing engagement between these elements. FIGS. 7A and 7B illustrate a third embodiment of the invention, in which annular liner portion 34 is hook-shaped or L-shaped in radial cross section, having an axial portion and a radial portion extending outwardly from the free end of the axial portion. The inside axial length of protrusion 34 in this embodiment is approximately equal to the thickness of finish flange 21. As container finish flange 21 is cammed radially inwardly and axially downwardly during sliding engagement with liner peripheral portion 38 as closure 12 is applied, trimmed surface 20 is brought into engagement with sealing surface 36 of liner protrusion 34. Continued application of the closure deforms protrusion 34, as illustrated in FIG. 7B, sealingly to capture the trimmed edge 20 of finish portion 21 inside of the hooked or L-shaped contour of protrusion 34.

There have thus been disclosed a closure, a container and closure package, and a method of making a container and closure package, that fully satisfy all of the objects and aims previously set forth. In each embodiment, the closure, and specifically the closure liner, is designed to make abutment sealing engagement with a trimmed surface on the container finish, thereby eliminating any leakage path that might otherwise occur due to attempted sealing engagement with an exterior untrimmed portion of the container finish that may contain a shoulder or ledge due to mold mismatch during the container forming process. Several embodiments and modifications have been disclosed, and other modifications will readily suggest themselves to persons of ordinary skill in the art in view of the foregoing discussion. The present invention is intended to embrace all such alternatives and modifications as fall within the spirit and broad scope of the appended claims.

What is claimed is:

1. A method of making a package that includes the steps of:

(a) blow molding a hollow plastic container, including blow molding a finish and a moil that extends from said finish, (b) trimming the moil from the container finish so as to leave a conical flange extending inwardly and upwardly from said finish terminating in a machine-trimmed surface, (c) providing a closure having a base wall and a peripheral skirt, and a liner secured to said base wall within said skirt, said liner having an annular protrusion that extends axially from said base wall, said protrusion having a sealing surface spaced from and facing toward said skirt, said sealing surface being selected from the group consisting of: (1) frustoconical, angulating inwardly and axially away from said base wall, (2) convex and (3) hook-shaped, and (d) securing said closure to said container finish in such a way that said flange of said container extending from said finish is deformed inwardly and downwardly by a peripheral portion of said liner to bring said trimmed surface into sealing engagement with said sealing surface on said liner.

* * * * *